US005243315A

United States Patent [19]

Rose

[11] Patent Number: 5,243,315

[45] Date of Patent: Sep. 7, 1993

[54] THERMOSTATIC SWITCH ASSEMBLY

[75] Inventor: Derek J. Rose, Mansfield, Ohio

[73] Assignee: Therm-O-Disc, Incorporated, Mansfield, Ohio

[21] Appl. No.: 962,665

[22] Filed: Oct. 19, 1992

[51] Int. Cl.[5] ..... H01H 37/52

[52] U.S. Cl. ..... 337/354; 337/370

[58] Field of Search ..... 337/370, 354, 371, 363, 337/364, 86, 87, 95, 96

[56] References Cited

U.S. PATENT DOCUMENTS 3,852,698 12/1974 Schmitt et al. ..... 337/354

4,035,756 7/1977 Schmitt ..... 337/370

*Primary Examiner*—Harold Broome

*Attorney, Agent, or Firm*—Jones, Day, Reavis & Pogue

[57] ABSTRACT

A thermostatic switch assembly having three individual switches vertically stacked one above the other on a base containing temperature responsive bimetal discs that operate the individual switches through actuating rods.

3 Claims, 2 Drawing Sheets

THERMOSTATIC SWITCH ASSEMBLY

BACKGROUND OF THE INVENTION

This application relates to the art of switch assemblies and, more particularly, to thermostatic switch assemblies of the type having temperature responsive bimetals that actuate switches. The invention is particularly applicable to thermostatic switch assemblies wherein the bimetals are heated by a thermistor having a positive temperature coefficient. However, it will be appreciated that the invention has broader aspects and can be used with other types of heaters or no heater at all.

Three thermostatically operated switches are often required to provide sequential timing of resistance heating elements and fans in electric furnaces, air conditioners and heat pumps. Voltage applied to a heater circuit activates one or more bimetals to open or close switch contacts. Removal of the voltage allows the bimetal to cool for returning the switch contacts to their normal state.

Requirements for three thermostatically operated switches are commonly met by using one thermostatic switch assembly having two thermostatically operated switches, and another separate thermostatic switch assembly having one thermostatically operated switch. Each individual thermostatic switch assembly requires its own heater for the bimetal and two such heaters draw significant in-rush current. Two individual thermostatic switch assemblies also occupy a larger space envelope and require individual mounting.

It Would be desirable to eliminate the need for two individual thermostatic switch assemblies in applications requiring at least three thermostatically operated switches. It would also be desirable to eliminate the need for more than one bimetal heater in order to significantly reduce the in-rush current.

SUMMARY OF THE INVENTION

A thermostatic switch assembly of the type described includes a base having at least one bimetal therein movable between opposite positions responsive to temperature changes. Three individual switches are vertically stacked one above the other on the base. Actuating means extends between the bimetal and the three switches for operating same responsive to movement of the bimetal between its opposite positions.

In a preferred arrangement, the switch actuating means comprises three independent elongated rod actuators, one for each of the switches. The rod actuators have three different lengths and are positioned side-by-side, with the longest of the rod actuators being in the middle.

The three switches have movable switch blades, and one of the rod actuators extends through one of the switch blades while another of the rod actuators extends through two of the switch blades.

The base includes a metal cup supporting the bimetal which is in the form of a disc, and a heater is providing for heating the cup. In a preferred arrangement, the heater is a thermistor having a positive temperature coefficient of electrical resistance.

The most preferred arrangement includes a pair of bimetal discs having different diameters, with the smaller diameter disc positioned below the larger diameter disc. Two of the switch actuating rods cooperate with the large diameter disc and one of the switch actuating rods cooperates with the smaller diameter disc.

The actuating rod that cooperates with the smaller disc extends through a central hole in the larger disc and actuates the uppermost one of the three switches.

Each of the three switches has a pair of contacts including a fixed contact and a movable contact. Two of the switches of their contact pairs vertically aligned, while the other switch has its pair of contacts displaced 8020 . The switch having its contact pair displaced 180° from the other contact pairs is preferably the middle switch in the stack of three.

Each switch has a switch case, and elongated fastener means extends through all of the switch cases for holding same in assembled relationship.

It is a principal object of the present invention to provide a thermostatically operated compact three pole sequencer.

It is another object of the invention to provide a thermostatic switch assembly having three switches arranged in a manner that provides economical manufacture and assembly.

It also an object of the invention to provide a thermostatic switch assembly having three thermostatically operated switches while requiring only a single heater for heating the bimetal that operates the switches.

DESCRIPTION OF A PREFERRED EMBODIMENT

Figure 1:
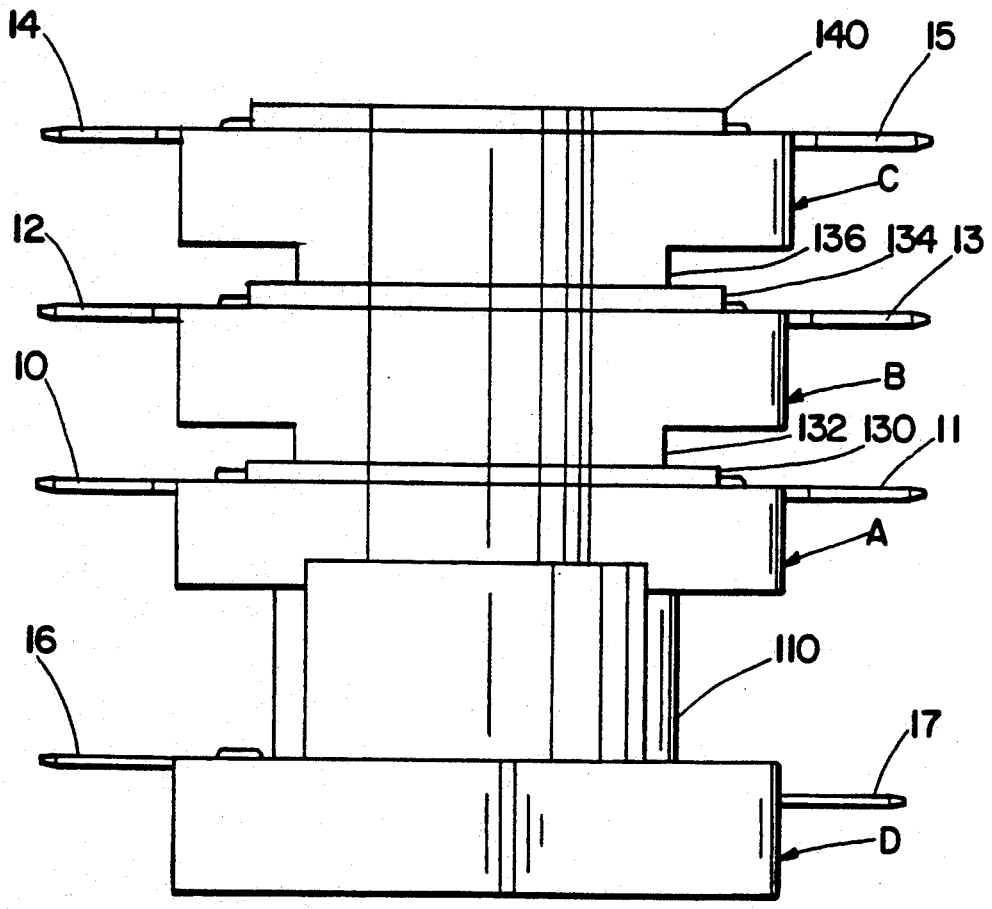
FIG. 1 is a side elevational view of a thermostatic switch assembly constructed in accordance with the present application.

Referring now to the drawing, wherein the showings are for purposes of illustrating a preferred embodiment of the invention only and not for purposes of limiting same, FIG. 1 shows three individual switch cases A, B and C vertically stacked on top of one another. Bottom switch case A also defines a base for the three switch cases. Each switch case contains a switch, and a pair of terminals on each switch case are provided for connecting the switch therein in an electric circuit. The terminals are identified by numerals 10, 11 for switch case A, 12, 13 for switch case B, and 14, 15 for switch case C.

A support base D is provided for supporting the assembled three switch cases A–C. Support base D includes terminals 16, 17 for connecting a heater in an electric circuit. Terminals 10–17 are attached to their respective cases by rivets in a known manner.

Figure 3:
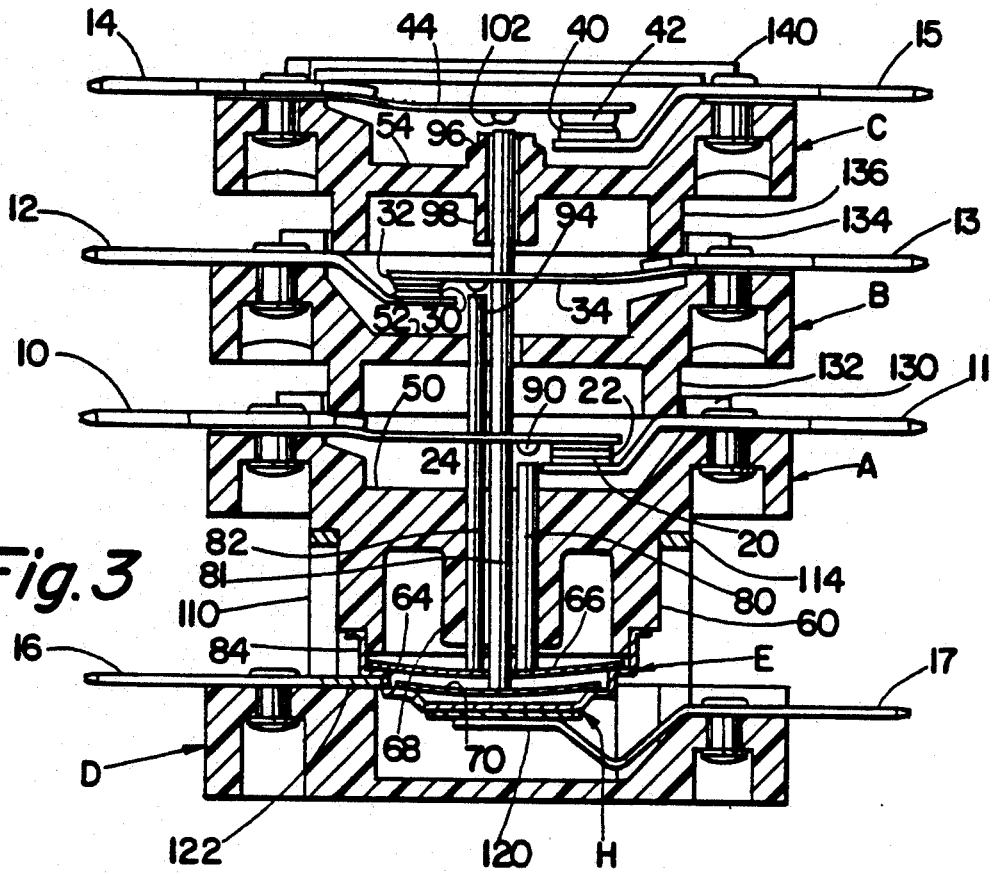
FIG. 3 is a cross-sectional elevational view taken generally on line 3—3 of FIG. 2.

With reference to FIG. 3, base switch case A has a pair of switch contacts including a fixed contact 20 mounted on terminal 11 and a movable contact 22 mounted on a flexible blade 24 connected with terminal 10. The switch in switch case B has a pair of contacts including a fixed contact 30 mounted on terminal 12 and a movable contact 32 mounted on a flexible switch blade 34 connected with terminal 13. The switch in switch case C has a pair of contacts including a fixed contact 40 mounted on terminal 15 and a movable contact 42 mounted on a flexible switch blade 44 connected with terminal 14.

As shown in FIG. 3, each switch case A–C has a cavity or depression therein in which the individual switches and switch contacts are received. The cavity or depression in each switch case has a bottom defined by a bottom wall 50 for switch case A, a bottom wall 52 for switch case B, and a bottom wall 54 for switch case C.

Base switch case A has a cylindrical wall 60 projecting downwardly therefrom and a metal cup E is attached to the bottom end portion of wall 60 in a known manner. Metal cup E is inwardly stepped to provide a first circular circumferential shoulder 64 supporting the periphery of a large diameter bimetal disc 66. An inwardly and downwardly-spaced second circular circumferential shoulder 68 supports the periphery of a small diameter bimetal disc 70.

Bimetal discs 66, 70 are shown in a preferred arrangement to be downwardly curved under ambient temperature conditions. When the discs are heated to an elevated temperature, they snap to an upwardly curved opposite position for actuating the switches. When the bimetals again cool, they snap downwardly to their original positions. The individual switches are also shown in a preferred arrangement to be normally closed. However, it will be recognized that the curvature of one or more of the bimetal discs can be reversed, and that one or more of the switches can be normally open instead of normally closed.

A heater H is bonded or otherwise secured to the bottom of metal cup E. Although heater H may be a thermistor or a conventional electrical resistance heater, it is preferably a PTC device whose electrical resistance increases sharply within a certain temperature range. When heater H is energized, heat is transferred by convection and conduction from metal cup E to bimetal discs 66, 70.

Actuating means for actuating the switches responsive to snapping of bimetal discs 66, 70 is shown in the form of three elongated cylindrical rods 80–82 of ceramic material. Base switch case A has a central downwardly extending projection 84 thereon and three side-by-side cylindrical holes are provided through bottom wall 50 and projection 84 for slidably receiving rods 80–82 with a relatively loose fit. The holes that receive the rods may intersect one another. The rods are located side-by-side with their longitudinal axes lying in a common vertical plane.

Flexible blade 24 has a downwardly extending dimple 90 thereon engagable by the upper end of shortest actuating rod 80 when bimetal disc 66 snaps upwardly to its opposite position for separating switch contacts 20, 22. Flexible switch blade 24 has a suitable opening therethrough for allowing free passage of actuating rods 81, 82 therethrough. Bottom wall 52 of switch case B has a pair of side-by-side cylindrical holes therethrough loosely receiving actuating rods 81, 82. The holes in bottom wall 52 may have their peripheries overlapping one another. In other words, the holes in the cases may be connected with one another at their peripheries. Flexible switch blade 34 in switch case B has a downwardly extending dimple 94 engagable by the upper end of medium length actuating rod 82 when large diameter bimetal disc 66 snaps upwardly to its opposite position for separating switch contacts 30, 32.

Bottom wall 54 in top switch case C has central upwardly and downwardly extending projections 96, 98 with a circular hole therethrough slidably receiving the upper end portion of longest actuating rod 81. A suitable hole through flexible switch blade 34 allows free passage of longest rod 81 therethrough. A downwardly extending dimple 102 on flexible switch blade 44 is engagable by the upper end of longest actuating rod 81 when small diameter bimetal disc 70 snaps upwardly to is opposite position for separating switch contacts 40, 42. A suitable central hole through large diameter bimetal disc 66 allows free passage of longest actuating rod 81 therethrough.

Pairs of switch contacts 20, 22 and 40, 42 in bottom and top switch cases A, C are in vertical alignment with one another. The pair of switch contacts 30, 32 in middle switch case B are displaced 180° from the pairs of contacts in switch cases A, C. In other words, switch contacts 30, 32 are located on the opposite side of the longitudinal axis of rod 81 from switch contacts 20, 22 and 40, 42.

Figure 5:
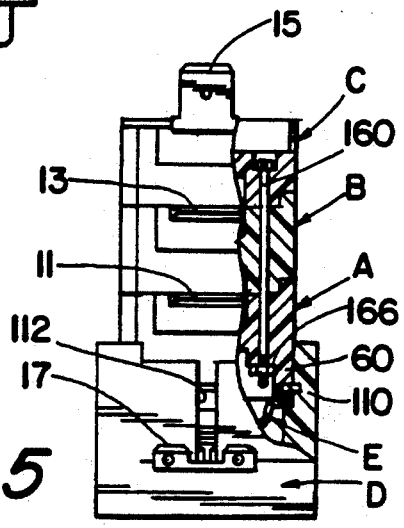
FIG. 5 is an end elevational view with portions cutaway and in section for illustrating an elongated fastener assembly that holds the individual switch cases in assembled relationship.

Support base D has an upwardly extending cylindrical wall 110 for closely receiving downwardly extending cylindrical wall 60 on base switch case A. Upwardly extending cylindrical wall 110 is circumferentially interrupted at diametrically opposite locations for receiving terminals 16, 17. One such interruption is shown as a slot 112 in FIG. 5. When downwardly projecting cylindrical wall 6 is fully received in upwardly extending cylindrical wall 110, a circumferential shoulder on base switch case A bottoms out on the upper end of cylindrical wall 110. Adhesive 114 may be provided between the shoulder and the upper end of cylindrical wall 110 for securing base switch case A to support base D. Obviously, ultrasonic welding or mechanical fasteners could also be used.

Terminals 16, 17 on support base D are preferably of spring metal, and terminal 17 has a contact 120 resiliently engaging heater H. Inner end portion 122 of contact 16 resiliently engages metal cup E on the opposite side of shoulder 64 thereof. Thus, there is a continuous electrical path from terminal 16 through metal cup E, heater H, contact 120 and terminal 17.

Base switch case A has an upwardly extending peripheral wall 130 receiving a downwardly extending peripheral wall 132 on middle switch case B. Upwardly extending peripheral wall 130 is interrupted at diametrically opposite locations for allowing passage of terminals 10, 11 therethrough.

Middle switch case B has an upwardly extending peripheral wall 134 receiving a downwardly extending peripheral wall 136 on top switch case C. Upwardly extending peripheral wall 134 is interrupted at diametrically opposite locations for allowing passage of terminals 12, 13 therepast.

Top switch case C has an upwardly extending peripheral wall 140 thereon that is also interrupted at diametrically opposite locations to allow passage of terminals 14, 15 therepast. The terminal ends of the diametrically opposite interruptions in wall 140 are indicated in FIGS. 2 and 4 at 151, 152 for terminal 14, and at 153, 154 for terminal 15.

Figure 2:
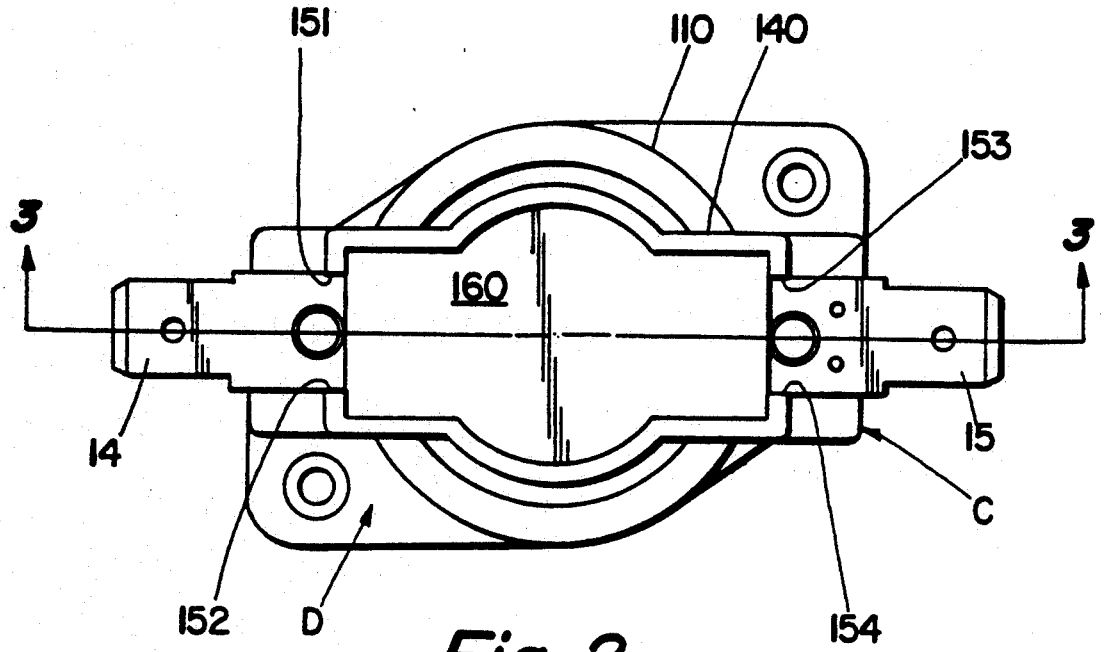
FIG. 2 is a top plan view of the thermostatic switch assembly of FIG. 1.

FIG. 2 shows a cover 160 received within upwardly extending peripheral wall 140 for closing the cavity within top switch case C in which the switch is located. Cover 160 may be adhesively secured within peripheral wall 140.

Figure 4:
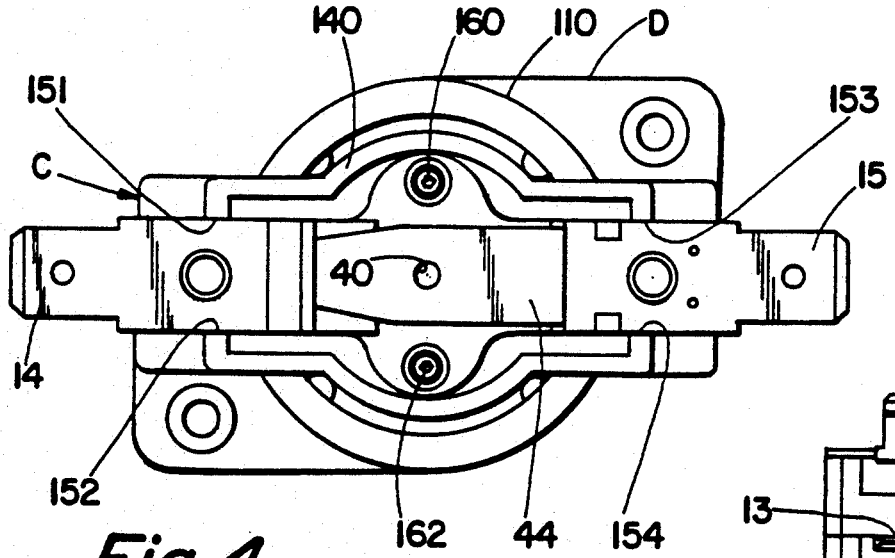
FIG. 4 is a top plan view of FIG. 3, and with a cover removed for showing the interior of an uppermost switch case.

Cover 160 of FIG. 2 is removed in the top view of FIG. 4 in order to show the interior of top switch case C beneath the cover. Bottom walls 50, 52 and 54 in switch cases A, B and C have aligned vertical holes therethrough on opposite sides of flexible switch blades 24, 34 and 44. These aligned holes in the bottom walls receive elongated bolts 160, 162. Nuts are threaded onto the bolts opposite from the enlarged headed ends thereof and only one such nut is shown at 166 in FIG. 5 for bolt 160. The bolt and nut assemblies tightly secure the three switch cases together into a contact unitary assembly. The close interdigitating relationship between upwardly and downwardly extending walls 130, 132 and 134, 136 also helps to hold the switch cases in aligned relationship.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A thermostatic switch assembly comprising a base having at least one bimetal therein movable between opposite positions responsive to temperature changes, at least three individual switches vertically stacked one above the other on said base, actuating means extending between said bimetal and said switches for operating said switches responsive to movement of said bimetal between said opposite positions, each said individual switch having a switch case, and elongated fastener means extending through all of said switch cases for holding said switch cases in assembled relationship.

2. A thermostatic switch assembly comprising a base having at least two temperature responsive bimetals therein, at least three individual switches vertically stacked one above the other on said base, a first elongated actuating rod extending between one of said bimetals and one of said switches, a second elongated actuating rod extending between said second bimetal and a second of said switches, and a third elongated actuating rod extending between said second bimetal and a third of said switches, each of said individual switches having a switch case, and elongated fastener means extending through all of said switch cases for holding same in assembled relationship.

3. A thermostatic switch assembly comprising a base including a metal cup having at least two temperature responsive bimetal discs supported therein, at least three individual switches vertically stacked one above the other on said base, first actuating means extending between one of said bimetals and at least one of said switches, second actuating means extending between the other of said bimetal discs and the remainder of said switches, heating means for heating said cup, and resilient biasing means for biasing said heating means into engagement with said cup.

* * * * *